US006186914B1

(12) United States Patent
Lin

(10) Patent No.: US 6,186,914 B1
(45) Date of Patent: Feb. 13, 2001

(54) WRIST BALL

(76) Inventor: Chien-Der Lin, No. 1-3, Lane 251, Tong-Yeang Road, Feng-Yuan, Taichung (TW)

( * ) Notice: Under 35 U.S.C. 154(b), the term of this patent shall be extended for 0 days.

(21) Appl. No.: 09/349,458

(22) Filed: Jul. 8, 1999

(30) Foreign Application Priority Data

Dec. 31, 1998 (TW) ..... 87222199

(51) Int. Cl.[7] ..... A63B 43/04; A63B 5/00

(52) U.S. Cl. ..... 473/594; 473/570; 482/44; 482/45

(58) Field of Search ..... 473/575, 576, 473/569, 594, 595, 570; 446/235, 240, 247, 248, 38; 482/44, 110, 45, 46, 49, 50

(56) References Cited

U.S. PATENT DOCUMENTS 3,237,342 * 3/1966 Bross ..... 446/38
4,684,124 * 8/1987 Escher ..... 482/110
5,399,136 * 3/1995 Bart ..... 482/110
5,800,311 * 9/1998 Chuang ..... 482/44
6,053,846 * 4/2000 Lin ..... 482/44

* cited by examiner

*Primary Examiner*—Steven Wong
(74) *Attorney, Agent, or Firm*—Browdy and Neimark

(57) ABSTRACT

A wrist ball comprises a lower shell and an upper shell which is joined with the top of the lower shell. The lower shell is provided therein with a bracing ring and a rotary member. The upper shell is provided at the top thereof with a round opening. The rotary member is provided in the periphery thereof with a groove which is in turn provided with a first engaging portion. The round opening of the upper shell is sealed off by a cap which is provided with two through holes for receiving a pull member. The pull member has a rod portion which is provided with a second engaging portion that is engaged with the first engaging portion of the rotary member. The rotary member is actuated by the pull member to rotate.

6 Claims, 9 Drawing Sheets

WRIST BALL

FIELD OF THE INVENTION

The present invention relates generally to a game equipment, and more particularly to a wrist ball.

BACKGROUND OF THE INVENTION

As shown in FIGS. 1–3, a wrist ball 10 of the prior art comprises mainly a semispherical lower shell 11 of a transparent plastic material, a bracing ring 12 disposed in the inside of the top end of the lower shell 11, a rotary member 13 provided with a center shaft 131 and a groove 132 extending along the outer periphery thereof and having a hole 133. The rotary member 13 is received in the bracing ring 12 such that both ends of the center shaft 131 are fastened pivotally with the bracing ring 12. A transparent upper shell 14 of a plastic material is joined with the top end of the lower shell 11 and is provided in the top thereof with a round opening 141.

As shown in FIG. 4, a cord 20 has a head end 25, which is inserted into the hole 133 of the rotary member 13. FIG. 7, shows that the rotary member 13 can be pressed by a thumb of a player. In the meantime as further shows in FIG. 7, the cord 20 is wound in the groove 132 along the direction indicated by an arrow 24 such that only a small segment of the cord 20 remains outside. As shown in FIG.6, the wrist ball 10 can be held in one hand while the cord 20 is pulled forcefully with other hand along the direction indicated by an arrow 21, so as to actuate the rotary member 13 to turn in the direction indicated by an arrow 22 as shown in FIG. 5. The rotary member 13 and the bracing ring 12 are also actuated by the centrifugal force to turn in the direction indicated by an arrow 23 as shown in FIG. 9. At this moment, the wrist ball 10 is held in a palm of a player in time, as shown in FIG. 8, such that the arm remains stationary, and that the palm is rotated on the "A" point serving as a fulcrum, so as to cause the wrist ball 10 to rotate clockwise along a circumferential track in an uninterrupted manner for testing a player's perseverance. As the wrist ball 10 is rotated forcefully, the rotational speed of the rotary member 13 accelerates to as fast as 80000 revolutions per minute. It must be noted here that wrist ball 10 buzzes at the time when the rotation of the rotary member 13 accelerates. As the palm stops turning, the rotary member 13 decelerates gradually to a complete stop.

Such a wrist ball 10 of the prior art as described above may present problems for a player, in that the upper shell 14 is provided at the top thereof with the round opening 141 through which the player is susceptible to injuries by the rotary member 13 in a high speed motion.

SUMMARY OF THE INVENTION

It is therefore the primary objective of the present invention to provide a wrist ball with a rotary member which is not exposed so as to protect a player of the wrist ball from injuries.

In keeping with the principle of the present invention, the foregoing objective of the present invention is attained by an improved wrist ball comprising a lower shell, an upper shell, a bracing ring, and a rotary member. The bracing ring and the rotary member are housed in the lower shell which is joined with the upper shell having in the top thereof a round opening. The present invention is characterized in design in that the periphery of the rotary member has a groove which is provided with a first engaging portion. In addition, the round opening of the upper shell is provided with a cap which is in turn provided with two through holes through which a rod portion of a pull member is engaged with the rotary member in such a manner that the first engaging portion of the rotary member is engaged with a second engaging portion of the rod portion of the pull member, and that the rotary member is actuated by the pull member to rotate.

DETAILED DESCRIPTION OF THE EMBODIMENTS

As shown in FIGS. 10–17, a wrist ball embodied in the present invention comprises the component parts which are described hereinafter.

A lower shell 30 is semispherical in shape and provided therein with a receiving space for disposing a bracing ring 31.

Figure 1:
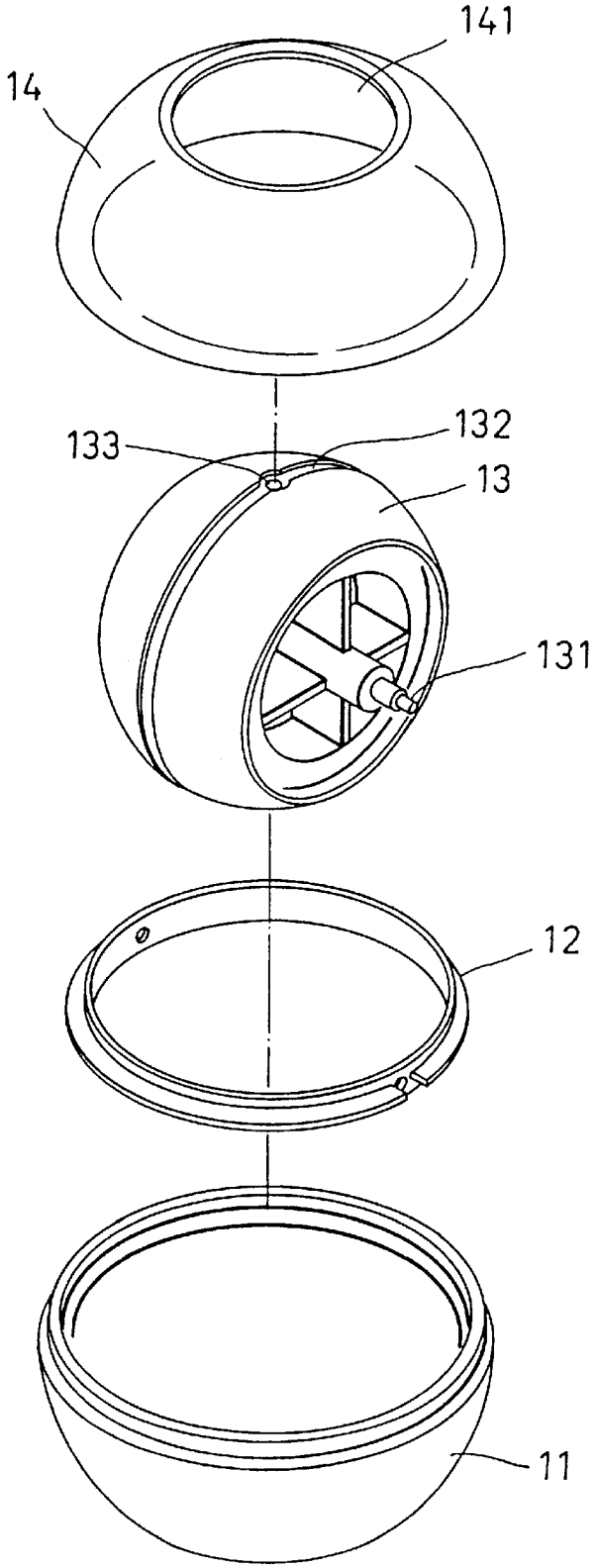
FIG.1 (PRIOR ART)
FIG. 1 shows an exploded view of a wrist ball of the prior art.
Figure 3:
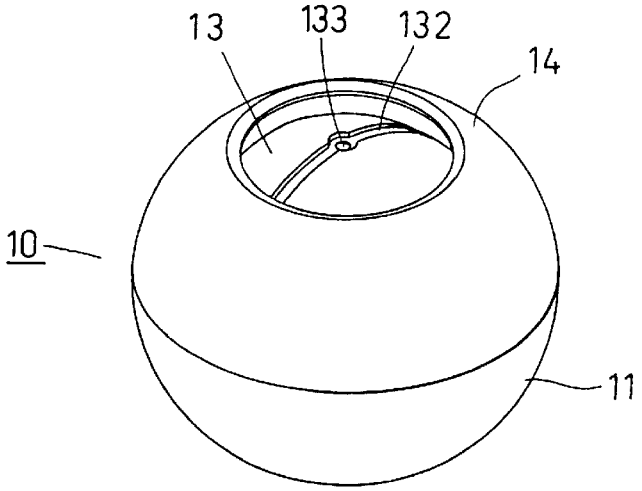
FIG. 3 (PRIOR ART)
FIG. 3 shows a complete perspective view of the prior art wrist ball in combination.
Figure 2:
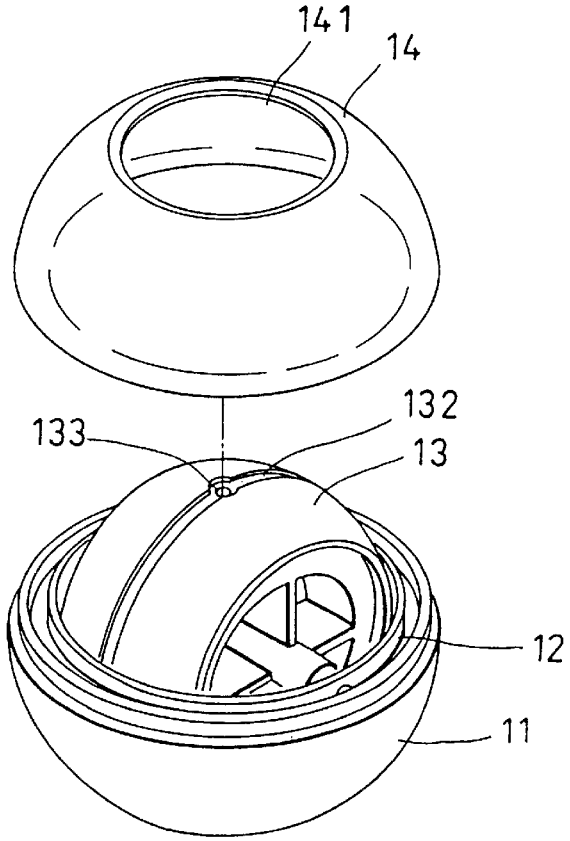
FIG. 2 (PRIOR ART)
FIG. 2 shows a partial perspective view of the prior art wrist ball in combination.
Figure 4:
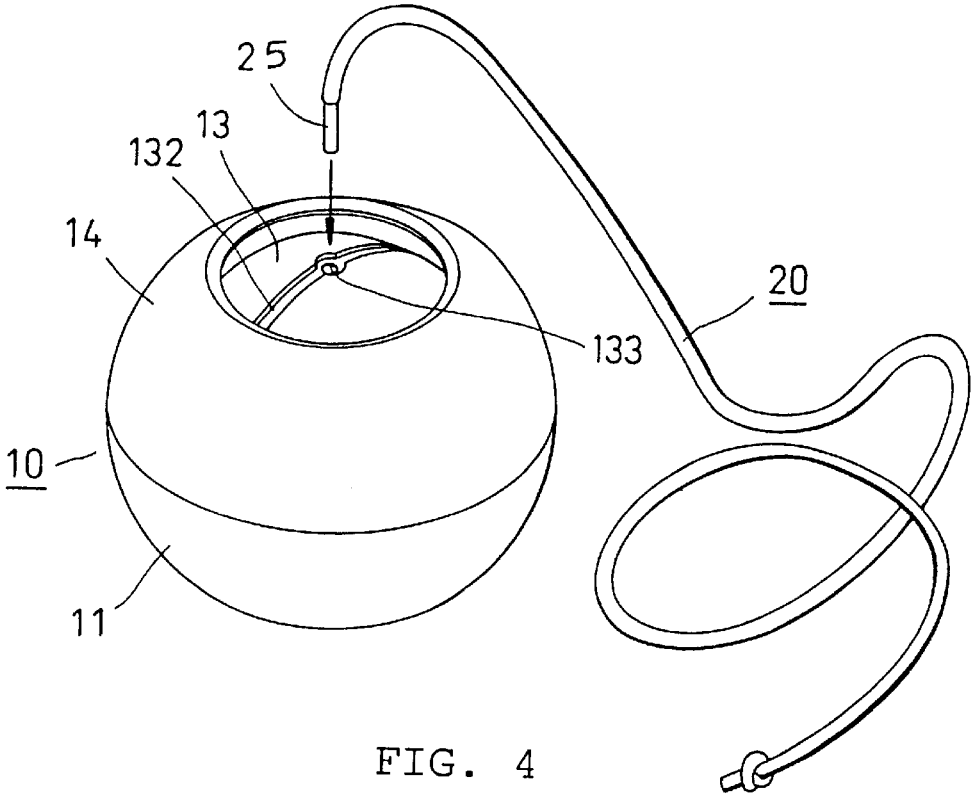
FIG. 4 (PRIOR ART)
FIG. 4 is a schematic view showing that the head end 25 of a cord 20 is about to be inserted into a hole 133 of the prior art wrist ball.
Figure 6:
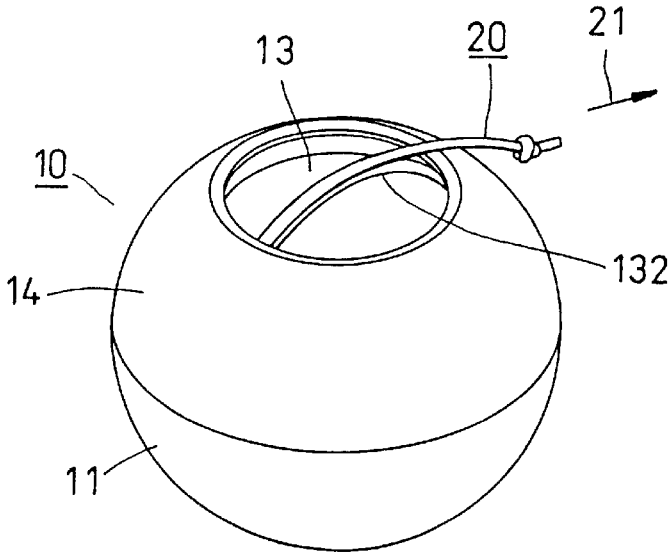
FIG. 6 (PRIOR ART)
FIG. 6 is a schematic view showing that the work of winding the cord 20 along the groove 132 of the prior art wrist ball is completed.
Figure 5:
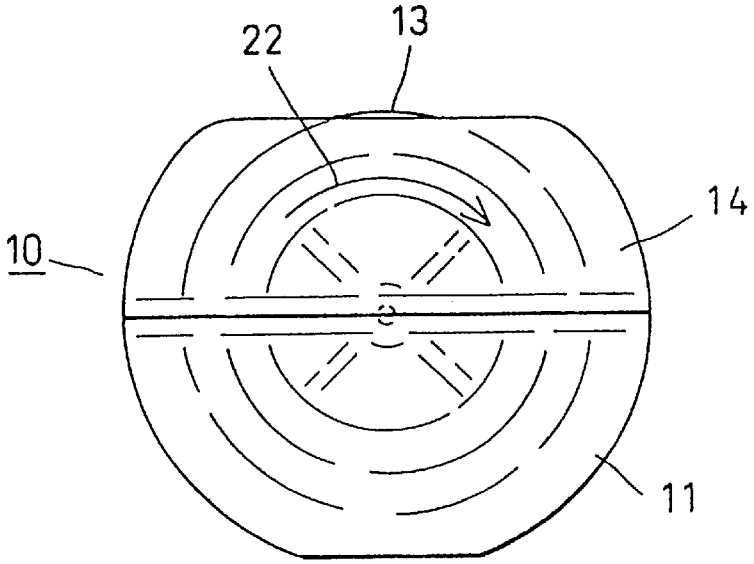
FIG. 5 (PRIOR ART)
FIG. 5 is a schematic view showing that the cord 20 is being wound along a groove 132 of the prior art wrist ball.
Figure 9:
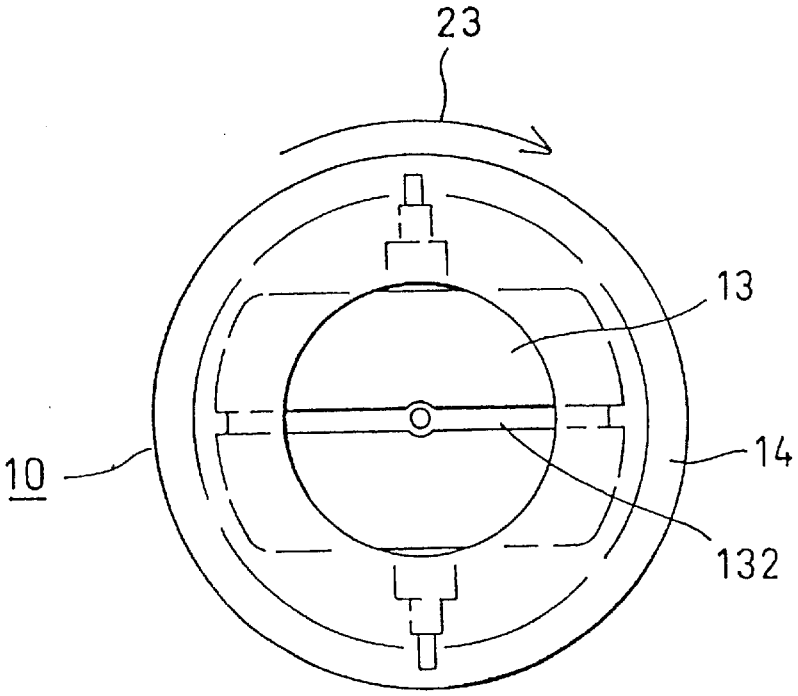
FIG. 9 (PRIOR ART)
FIG. 9 shows a schematic view of the prior art wrist ball at work.
Figure 7:
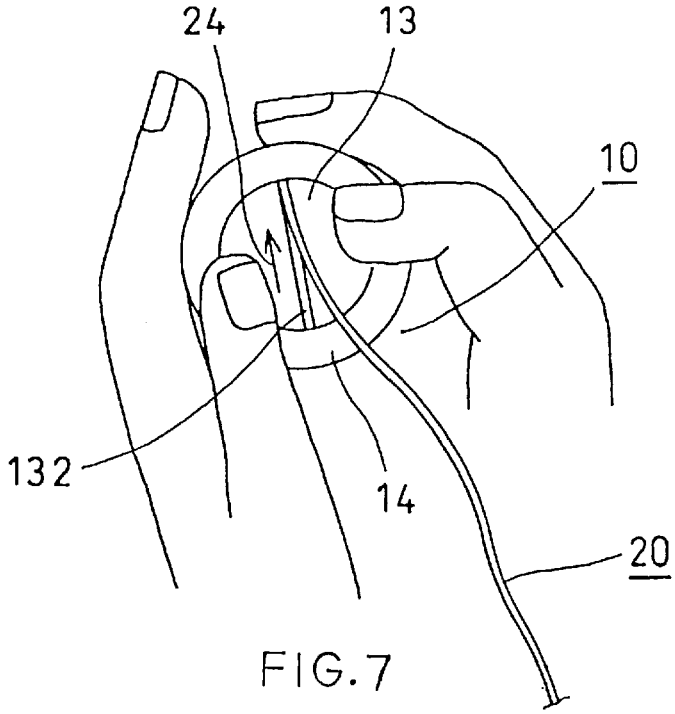
FIG.7 (PRIOR ART)
FIG. 7 is a side plan view of the prior art wrist ball to show the rotational direction of the prior art wrist ball to shown the rotational direction of the rotary member 13.
Figure 8:
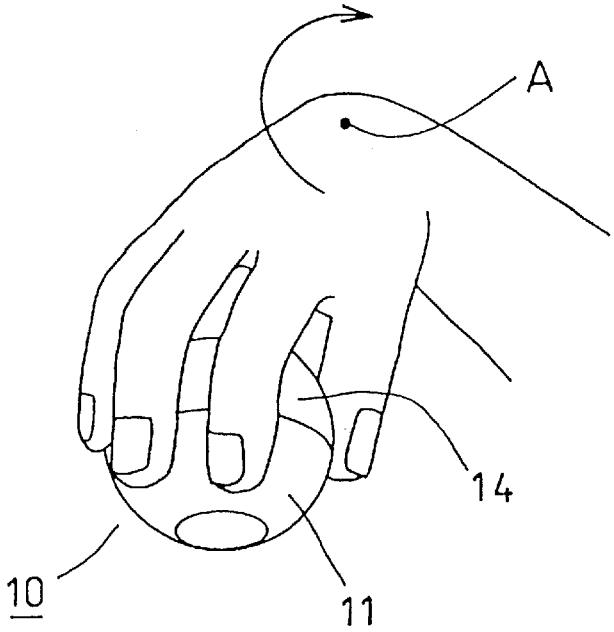
FIG.8 (PRIOR ART)
FIG. 8 is a top plan view of the prior art wrist ball to show that the rotary member 13 can be actuated to turn in a direction indicated by an arrow 23.
Figure 10:
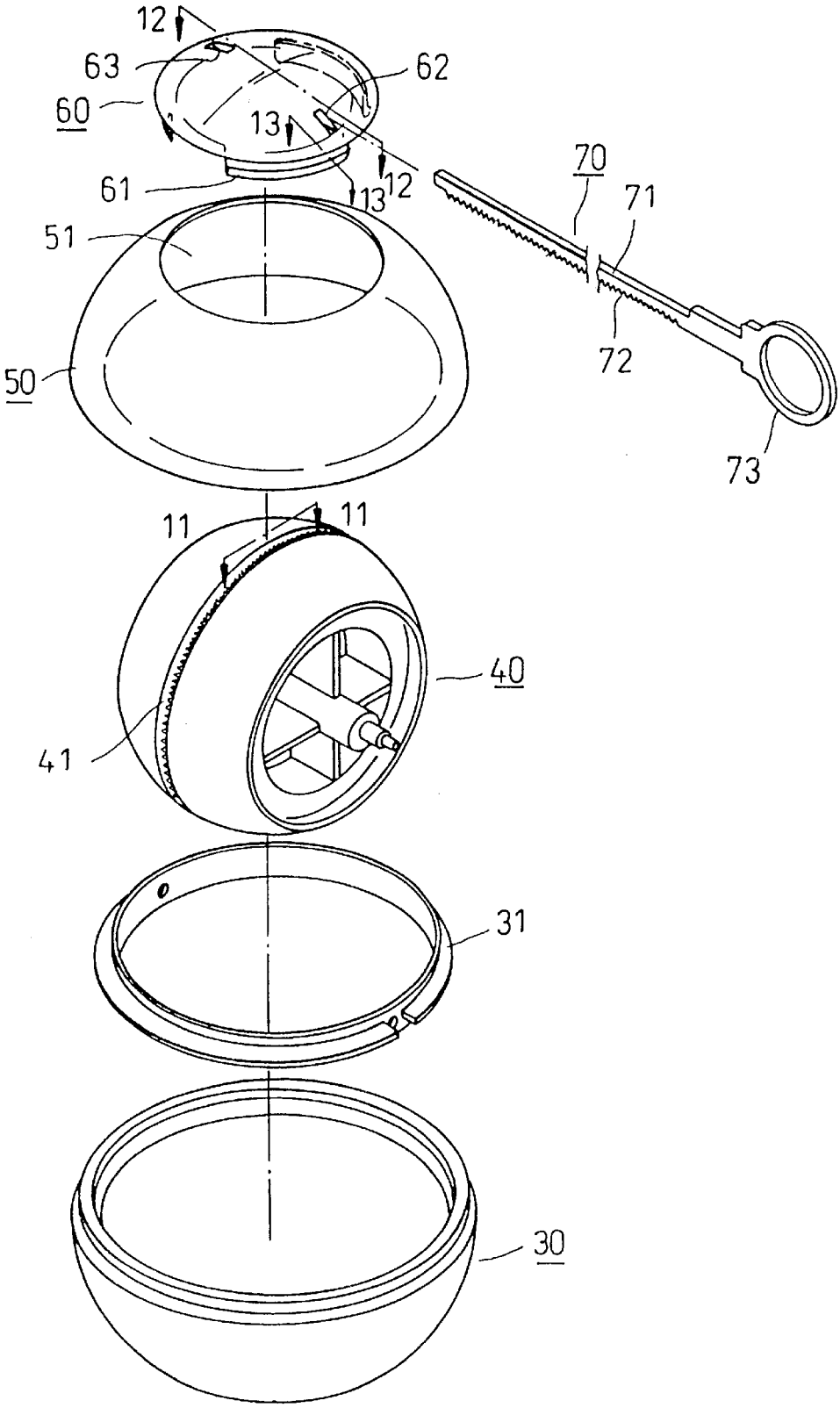
FIG. 10 shows an exploded view of a wrist ball embodied in the present invention.
Figure 12:
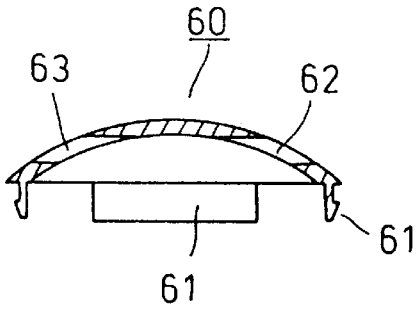
FIG. 12 shows a sectional view of a cap 60 taken along the direction indicated by a line 12—12 as shown in FIG. 10.
Figure 11:
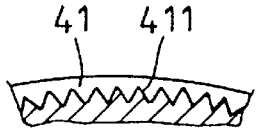
FIG. 11 shows a sectional view of a rotary member 40 taken along the direction indicated by a line 11—11 as shown in FIG. 10.
Figure 14:
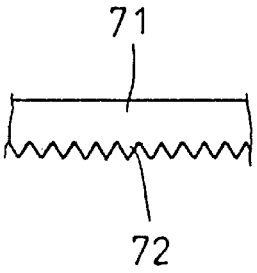
FIG. 14 shows an enlarged view of the "B" portion of a pull member 70 as shown in FIG. 10.
Figure 13:
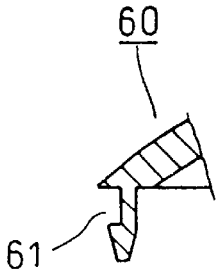
FIG. 13 shows a sectional view of the cap 60 taken along the direction indicated by a line 13—13 as shown in FIG. 10.
Figure 16:
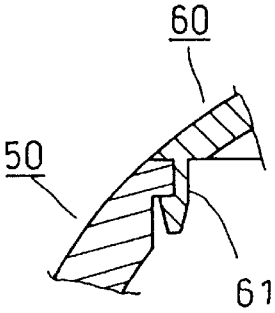
FIG. 16 shows a sectional view of a portion taken along the line 16—16 as shown in FIG. 15.
Figure 15:
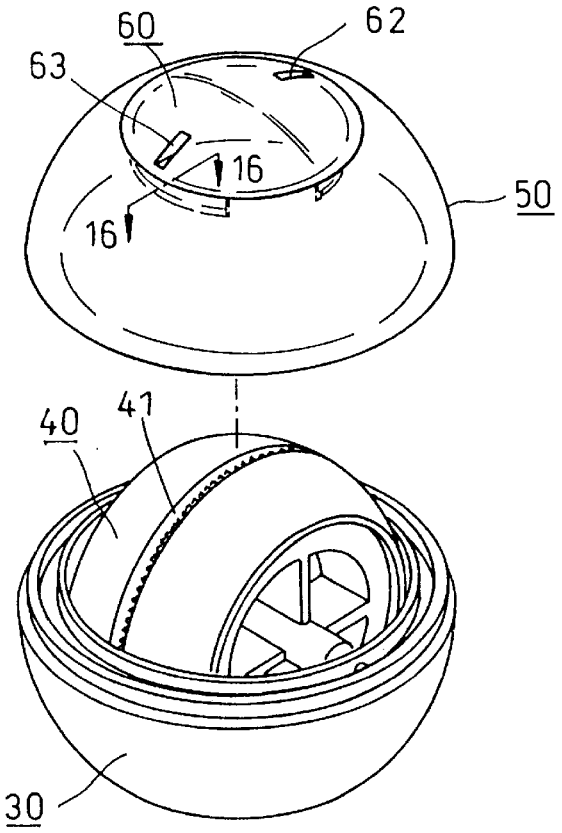
FIG. 15 shows a partial perspective view of the present invention in combination.

A rotary member 40 is mounted rotatably on the bracing ring 31 and is provided in the periphery thereof with a groove 41. The groove 41 is provided with a first engaging portion 411 of a serrated construction as shown in FIG. 11.

An upper shell 50 is semispherical in shape and is provided with an open bottom for joining with an open top of the lower shell 30. The upper shell 50 is further provided at the top thereof with a round opening 51.

A transparent cap 60 is provided along the edge of the underside thereof with a plurality of retaining portions 61 separated from one another at an interval. The round opening 51 of the upper shell 50 is sealed off by the cap 60 which is provided with two through holes 62 and 63 opposite in location to each other.

A pull member 70 has a rod portion 71 which is provided with a second engaging portion 72 of a serrated construction and extending along the direction of the longitudinal axis of the rod portion 71. The rod portion 71 is further provided at the rear end thereof with a grip portion 73.

Figure 17:
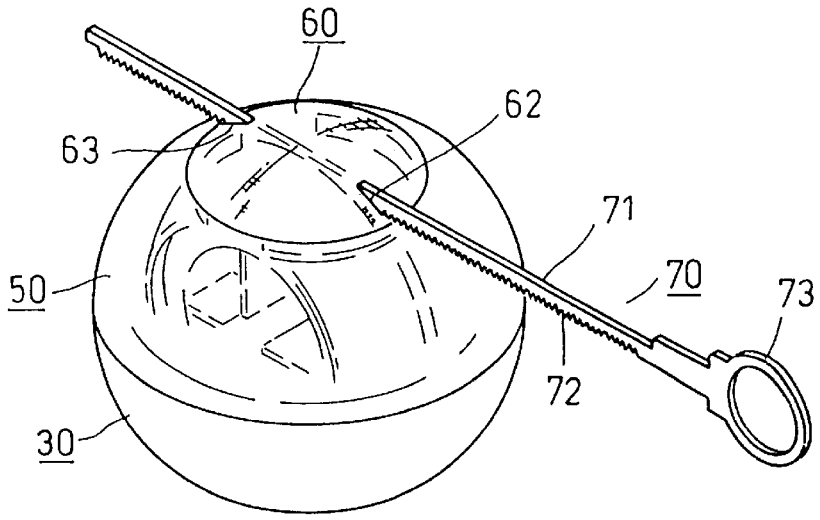
FIG. 17 shows a perspective view of the present invention in combination.
Figure 18:
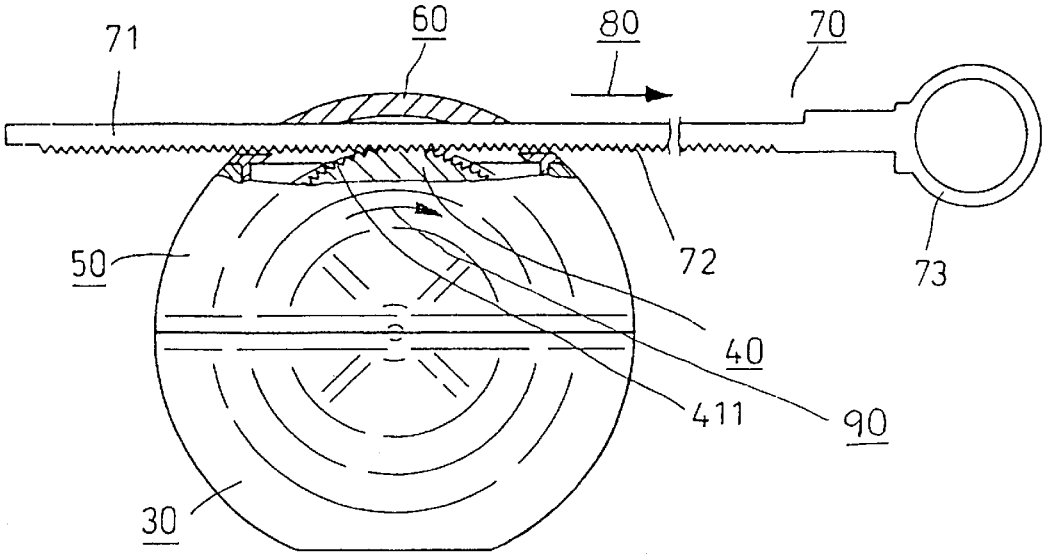
FIG. 18 shows a schematic view of the present invention at work.

As shown in FIG. 17, before the wrist ball of the present invention is ready for action, the front end of the rod portion 71 of the pull member 70 is put through the through holes 62 and 63 of the cap 60. Now referring to FIG. 18, the cap 60 is rotated such that the second engaging portion 72 of the pull member 70 is engaged with the first engaging portion 411 of the rotary member 40. Thereafter, the pull member 70 is pulled in the direction indicated by an arrow 80, so as to actuate the rotary member 40 to turn in the direction indicated by an arrow 90. The pull member 70 is then pulled out. The rotary member 40 in motion is accelerated with the wrist of a player.

The rotary member 40 of the present invention is shielded by the cap 60 in conjunction with the pull member 70, so as to provide the player with protection against injuries caused by the rotary member 40 in a high speed motion.

Figure 20:
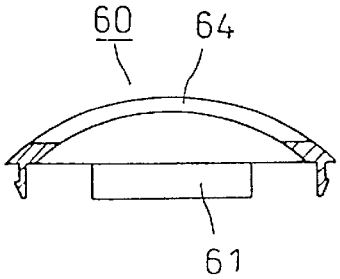
FIG. 20 shows a sectional view taken along a line 20—20 as shown in FIG. 19.
Figure 19:
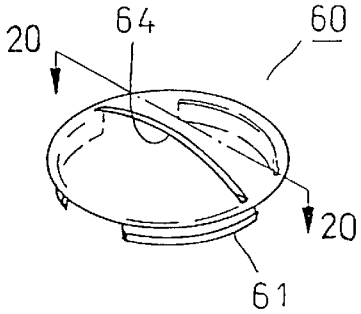
FIG. 19 shows a schematic view of the cap 60 of another embodiment of the present invention.

As shown in FIGS. 19 and 20, the cap 60 of the present invention is modified such that the cap 60 is provided with a long striplike slot hole 64 for the pull member 70 to be placed so as to actuate the rotary member 40 to turn.

What is claimed is:

1. A wrist ball comprising:

a lower shell of a semispherical shape and provided therein with a receiving space, said lower shell having an open top;

a bracing ring engaged in the lower shell;

a rotary member rotatably engaged to said bracing ring and provided in a periphery thereof with a groove;

an upper shell of a semispherical shape having an open bottom for joining with said open top of said lower shell, said upper shell provided at a top thereof with a round opening;

wherein said groove of said rotary member is provided with a first engaging portion of a serrated construction;

wherein said round opening of said upper shell is sealed by a cap engaged to the upper shell in the round opening, said cap provided with two through holes opposite in location to each other;

a pull member comprising a rod portion having a second engaging portion of a serrated construction;

said rod portion being received in said two through holes of said cap such that said second engaging portion is engageble with said first engaging portion of said rotary member;

wherein when said pull member is engaged to the rotary member and pulled through the two through holes, the rotary member is actuated.

2. A wrist ball comprising:

a lower shell of a semispherical shape and provided therein with a receiving space, said lower shell having an open top;

a bracing ring engaged in the lower shell;

a rotary member rotatably engaged to said bracing ring and provided in a periphery thereof with a groove;

an upper shell of a semispherical shape having an open bottom for joining with said open top of said lower shell, said upper shell provided at a top thereof with a round opening;

wherein said groove of said rotary member is provided with a first engaging portion of a serrated construction;

wherein said round opening of said upper shell is sealed by a cap engaged to the upper shell in the round opening, said cap provided with a slot;

a pull member comprising a rod portion having a second engaging portion of a serrated construction;

said rod portion being received in said slot of said cap such that said second engaging portion is engagable with said first engaging portion of said rotary member;

wherein when said pull member is engaged to the rotary member and pulled through the slot, the rotary member is actuated.

3. The wrist ball as defined in claim 2, wherein said pull member is provided with a grip portion fastened with a rear end of said portion.

4. The wrist ball as defined in claim 1, wherein said cap is provided with fastening means for engaging the upper shell.

5. The wrist ball as defined in claim 2, wherein said cap is provided with fastening means for engaging the upper shell.

6. The wrist ball as defined in claim 1, wherein said pull member is provided with a grip portion fastened with a rear end of said rod portion.

* * * * *